United States Patent [19]

Nové et al.

[11] Patent Number: 4,834,168

[45] Date of Patent: May 30, 1989

[54] DEVICE FOR ELECTROMAGNETICALLY STIRRING LIQUID METAL ON A CONTINUOUS CASTING LINE

[75] Inventors: Marie C. Nové, Paris; Michel Kouyoumdjian, Chatou, both of France

[73] Assignee: Alsthom, Paris, France

[21] Appl. No.: 180,754

[22] Filed: Apr. 12, 1988

[30] Foreign Application Priority Data

Apr. 13, 1987 [FR] France ..... 87 05202

[51] Int. Cl.[4] ..... B22D 27/02

[52] U.S. Cl. ..... 164/504; 164/468

[58] Field of Search ..... 164/468, 504

[56] References Cited

U.S. PATENT DOCUMENTS 4,139,048 2/1979 Andersson ..... 164/504

4,256,165 3/1981 Von Starck et al. ..... 164/504

FOREIGN PATENT DOCUMENTS 0197482 10/1986 European Pat. Off. .

3510261 10/1985 Fed. Rep. of Germany .

2379339 9/1978 France .

2485411 12/1981 France .

*Primary Examiner*—Kuang Y. Yin

*Attorney, Agent, or Firm*—Sughrue, Mion, Zinn, Macpeak & Seas

[57] ABSTRACT

The inductor comprises two portions each having its own casing (3, 4) and capable of pivoting about a hinge (7), thereby enabling the inductor to be opened and removed rear-wardly on a supporting carriage (8), as shown. The carriage is advanced when the inductor is to be closed around metal being cast (A) from a continuous casting mold (1).

6 Claims, 5 Drawing Sheets

DEVICE FOR ELECTROMAGNETICALLY STIRRING LIQUID METAL ON A CONTINUOUS CASTING LINE

The present invention relates to obtaining an elongate metal product by continuous casting.

BACKGROUND OF THE INVENTION

It relates more particularly to electromagnetic equipment usable to stir the metal which remains liquid inside the product as it moves along the casting line. As it moves, the cast product cools and solidifies little by little from its surface, and it is conventional practice to stir the metal which is still liquid, since moving said metal improves the final metallurgical quality of the cast product. This motion is generated by electro-magnetic induction and is referred to as "electromagnetic stirring". Industrially, such stirring is performed at one or more levels along a continuous casting line: level with the ingot mold (referred to as level M by the person skilled in the art); beneath the mold in the secondary cooling zone (level S); and at the bottom of the solidification well (level F).

Stirring can be obtained by means of a moving magnetic field which may be rotating or sliding, and which penetrates into the cast product.

These magnetic fields are produced by polyphase static inductors placed as close as possible to the cast product. Rotating fields are produced by "rotary" inductors and sliding fields are produced by "linear" inductors.

When it is desired to stir in a plane which is perpendicular to the casting axis, rotary stirring is suitable for products which are round, square, or only slightly oblong, i.e. products which are nearly square in section, such as billets and blooms. In such applications, the rotary inductor provides the best achievable penetration of the magnetic induction into the core of the cast product and thus acts effectively throughout the bulk of the liquid to be stirred.

In contrast, linear stirring is suitable for flat products, such as slabs.

Prior rotary inductors have always been constructed in such a manner as to create magnetic induction which passes through the cast product perpendicularly to the casting axis, with the induction being caused to rotate about said axis by feeding the inductor with polyphase electricity (generally two-phase for a square inductor and three-phase for a round inductor). In order to ensure that the magnetic field rotates uniformly, the inductor completely surrounds the cast product. More precisely, a rotating field inductor which does not completely surround the cast product has neither been manufactured nor proposed in public, and it has seemed economically impossible to use a rotating field when the configuration of the continuous casting machine at the level at which the stirring is to be performed is not suitable for allowing the inductor to completely surround the cast product.

Under such circumstances, a linear inductor has been used disposed over the most accessible face of the casting line or over its only accessible face. In other words the lower efficiency of such an inductor has been accepted in cases where rotary stirring would be the most effective.

In order to benefit from the effectiveness of rotary stirring in spite of the problem posed by the lack of available space around the casting line, a first solution could be to make use of a plurality of partial inductors which are mechanically separate but which are electrically and magnetically coupled, and to dispose the partial inductors symmetrically around the cast product so as to cause them to produce a rotating field like a conventional single rotary inductor. However, this solution does not always overcome all of the difficulties encountered for locating a rotating field inductor on a pre-existing continuous casting line.

This may happen when the path followed by the metal is vertical on leaving the mold and then curves progressively to the horizontal. This curvature of the casting line forms a concave side and a convex side. If rotary stirring is then to be performed immediately below the mold at a location where the skin of solidified metal on the surface of the cast product is still thin and where it is consequently essential to guide the cast product over substantially all of its perimeter and along a certain distance by supporting rolls which are very close to one another, and if, in addition, the inductor cannot be disposed within the rolls because of the relatively high stirring power which is to be applied, it is then necessary to dispose the inductor around the rolls. But this can be done easily only by applying the inductor or the two half inductors from the concave side of the line because the convex side is occupied by the beams which constitute a support structure for supporting the casting line as a whole. This way of inserting the inductor generally requires the first guide segment (i.e. the structure which includes and supports the rolls) to be removed in order to put the inductor or one of the two half inductors in place or to remove it, and this gives rise to considerable constrains in maintenance and assembly operations.

Other cases can also occur in which it is difficult or even impossible to put two half inductors or a single rotary inductor of conventional design into place because of the configuration of the casting line, assuming that prior art types of rotary field inductor are the only kind available.

An object of the present invention is to make it possible and easy to install, operate, maintain, and replace an inductor device in most of those cases where the configuration of the continuous casting line under consideration would appear to present difficulties at the intended stirring level.

SUMMARY OF THE INVENTION

To this end, the present invention provides a device for electromagnetically stirring liquid metal on a continuous casting line, the device being designed to perform stirring in the vicinity of a continuous casting mold, said stirring taking place in the internal liquid mass of a cast metal product which leaves said mold along a casting axis and which descends continuously therealong, said mass being surrounded by an outer skin of solidified metal which is initially thin, said cast product being surrounded by a guide segment including supporting rolls, said device including an inductor for performing stirring, said inductor at least partially surrounding at least said cast product and being suitable for causing a magnetic field to penetrate therein substantially perpendicular to said axis and rotating thereabout, said inductor being heavy and including at least windings for creating said magnetic field, a rigid casing for holding said windings, and cooling circuits, said device further including an electricity control box for feeding said windings from an external source, and a water control box for feeding cooling circuits, wherein that said inductor is constituted by two separable inductor portions disposed substantially on either side of a plane of separation passing through said casting axis, each of said portions including windings, a casing, and a cooling circuit specific thereto, said device further including separation means enabling the casings of the two inductor portions to move apart on either side of said separation plane along inductor opening and closing motions, and an inductor-carrying carriage carrying said two inductor portions and said separation means and suitable for moving between a leading, in-service position placing said inductor around said cast product, and a retracted or trailing position which disengages the space around said product.

Depending on circumstances, it is possible to adopt the following preferred dispositions:

Said separation means comprise a hinge guiding rotation of said casings about an axis of rotation which extends substantially parallel to said casting axis and which is situated on the rear side of the inductor, and support means carried by said carriage for supporting each of the two casings during limited rotation about said axis of rotation so as to enable said inductor to be opened at its leading end in order to enable said inductor-carrying carriage to perform said displacements, and also to at least partially close said inductor around said cast product when said carriage is in its operating position for stirring the liquid metal in said product.

Said carriage is in the form of a lying-down U-shape opened at its front end in order to engage the two branches of the U on either side of said cast product, each of said casings being provided at the bottom thereof with running means which, during said opening and closing movements, run along a path formed on the top face of the corresponding one of said branches, thereby constituting said support means.

Said electricity and water control boxes are disposed at the rear of said inductor.

In the event that the axis of a continuous casting line begins by being substantially vertical and then curves progressively towards a horizontal casting direction by passing through intermediate directions, thereby defining a concave said facing said horizontal casting direction and an opposite, convex side, and that a line-supporting structure is disposed on the convex side of said line and thereby hindering access to the line from said side; said axis of rotation extends along one of said intermediate directions close to the vertical, the direction of carriage displacement is horizontal in order to facilitate said displacement, and said front side of the inductor and the carriage looks towards said convex side.

In the event that stirring is to be performed at a level on a continuous casting line where supporting rollers for supporting the cast product are very close to one another, said inductor in the operating position surrounds not only the cast product but also said guide segment, and the supporting rollers and their bearings situated in the magnetic field are made of non-magnetic or austenitic steel, as is, optionally, the entire segment.

Each of said casings is guided and carried by said hinge and said carriage via a support.

Said water control box is carried by said carriage and is connected to circuits for cooling said inductor portions via flexible ducts, and to an external supply via an inlet duct and an outlet duct which are likewise flexible.

The electrical control box is carried by said carriage and feeds each of said two inductor portions by means of flexible wires and via two terminal boxes each fixed to a respective one of said inductor portions.

Said inductor is a multi-phase bipolar inductor constituted by two half-inductors each comprising one of said inductor portions and each contained in one of said metal casings, said two half-inductors being mechanically separable and electrically and magnetically coupled to each other in order to be equivalent, in operation, to a single inductor.

The device also includes mechanical means for opening, closing, and locking said supports and said inducting portions in the operating position.

In general, the device also includes an electrical and hydraulic control desk from which the water feed and electricity supply operations are performed.

A device in accordance with the invention thus comprises two halves of a mechanical assembly which are hinged about a hinge and provided with maneuvering means and feed means. It may be used to advantage in a wide range of practical situations. It may be constituted by two mechanically separable half inductors which are electrically and magnetically coupled which either completely or nearly completely surround the continuous casting line at the desired stirring level after being locked together, or else which are disposed against two opposite faces of the line. However, the device may equally well be constituted by two inductors which are distinct from the electrical and magnetic points of view, either partially surrounding the continuous casting line, or else placed on two opposite faces thereof.

The invention is particularly advantageously when it is desired to use a rotating field and the configuration of the continuous casting line hinders the installation of a conventional type of rotating field inductor. In this case, the half inductors when locked in the operating position are practically equivalent to a conventional type of rotary inductor completely surrounding the continuous casting line at the level under consideration.

By virtue of the invention, it is particularly easy to handle, maintain, and replace the inductor portions.

In order to facilitate understanding of the invention, there follows a description by way of non-limiting example of an inductor carrier in accordance with the invention mounted on a U-shaped carriage for use with two three-phase bipolar half-inductors generally constituting a circular base cylinder for placing a level S, immediately below the continuous casting mold for a billet in a zone where the rolls for supporting the cast metal product are very close to one another and are disposed against all four faces of the product, with the assembly thereof constituting a "guidance segment".

BRIEF DESCRIPTION OF THE DRAWINGS

An embodiment of the invention is described by way of example with reference to the accompanying drawings, in which.

MORE DETAILED DESCRIPTION

Figure 1A:
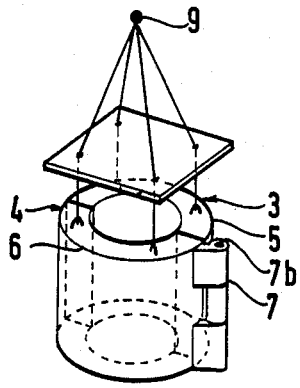
FIGS. 1A, 1B, and 1C show a device in accordance with the invention in a simplified diagrammatical cavalier projection perspective view in three successive stages of use.
Figure 1B:
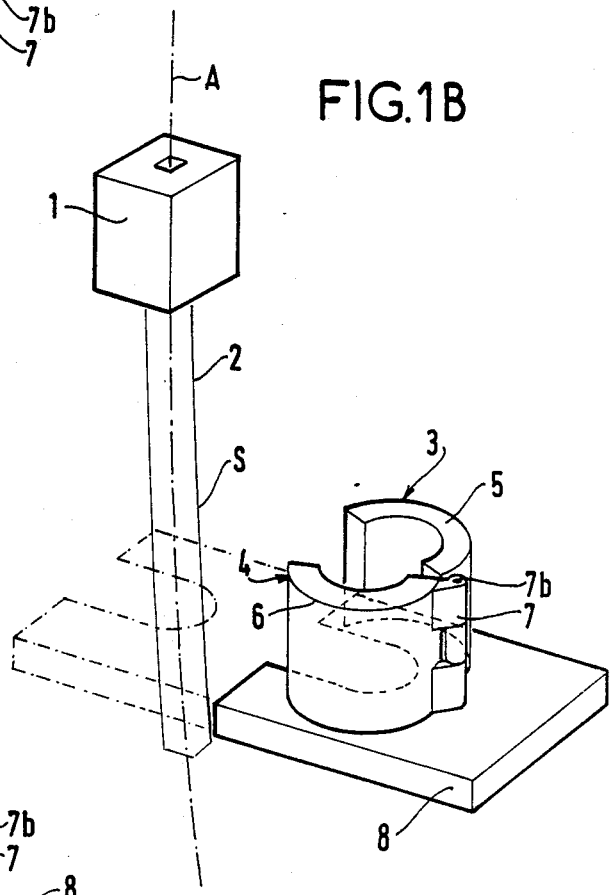
Figure 1C:
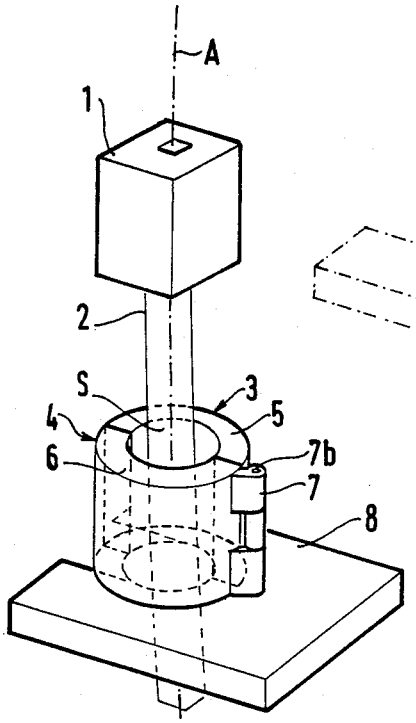

FIGS. 1A, 1B, and 1C enable the principle of the invention to be understood.

The curved axis of a casting line is referenced A. This axis simultaneously represents the path followed by the cast metal product which, in this case, is a steel bloom. The bloom is represented solely by its axis. it is formed in a continuous casting mold 1 from which it flows, and which is associated downwardly with four series of rolls which are very close together and with one series on each face of the bloom. The envelope defined by the rolls is approximately square in section and constitutes a "segment" 2. The liquid portion of the product is to be electromagnetically stirred at level S of the segment.

Casings 3 and 4 contain the two half-inductors together with their respective supports 5 and 6 which are hinged about a pin 7*b* of a hinge 7, and which stand on a U-shaped carriage 8 capable of horizontal translation motion.

The two half-inductors are put into place around the segment 2 at level S by a mechanical device in accordance with the invention as follows, with reference to the three stages shown in FIGS. 1A, 1B, and 1C.

At 1A, the casings 3 and 4 of the two half-inductors, their supports 5 and 6, and the hinge 7 are in the closed position and are suspended from a hoist 9 which places them on the carriage 8 at stage 1B, said carriage having a U-shaped slot facing the segment 2. The two halves of the device are then partially opened by mechanical means (not shown in these figures but visible in FIGS. 2 and 3), and simultaneously a cooling water feed, a cooling water return, and electrical cables are connected thereto by flexible means (not shown).

The carriage 8 is then thrust by mechanical means towards the segment 2 until it occupies the position shown in FIG. 1C (and shown in dot-dashed lines in FIG. 1B). The two halves of the hinged device are then closed and a locking device is operated on the side opposite to the hinge 7.

The inductor constituted by the two half-inductors is then in the operating position at level S.

It is subsequently removed by performing the same sequence of operations as for installing it, but in reverse order.

Figure 2:
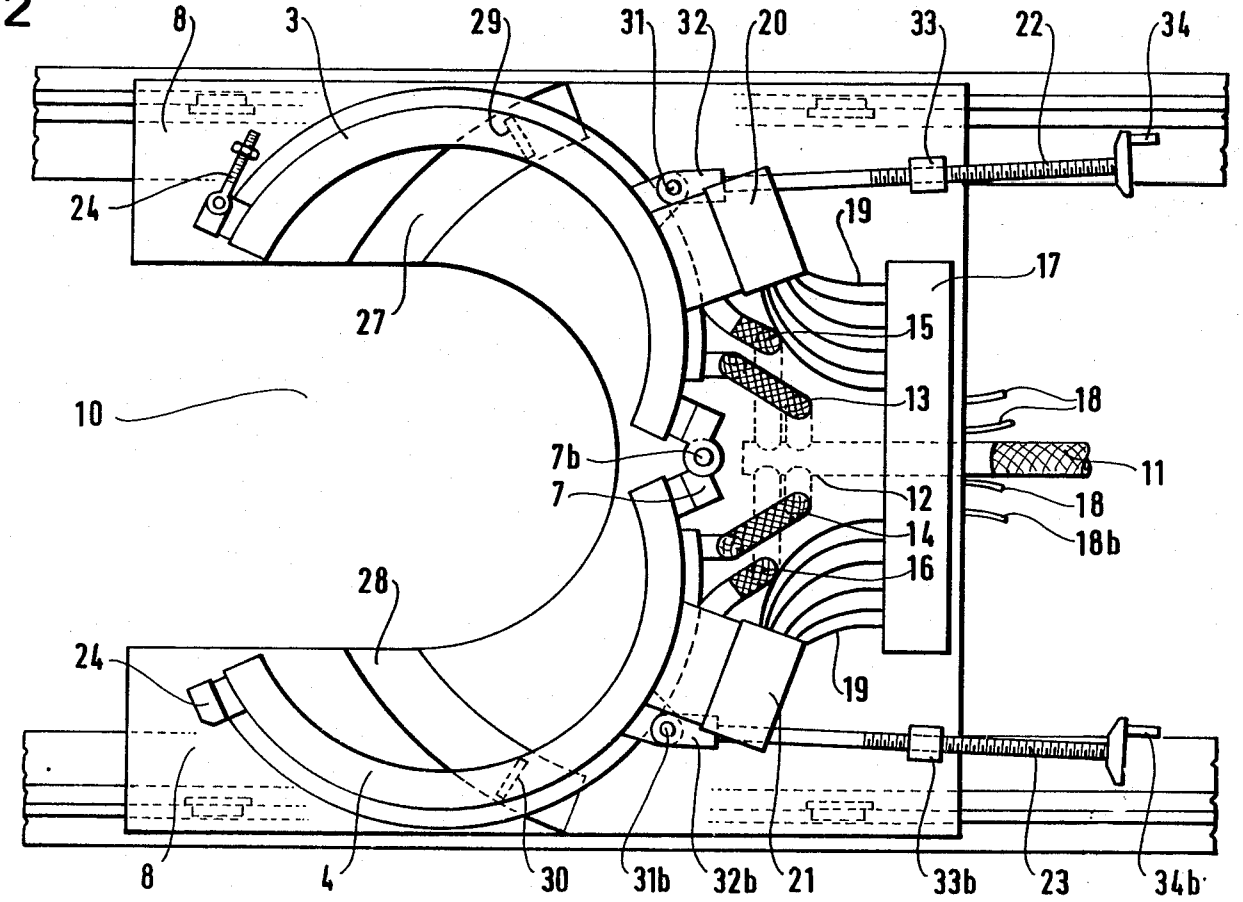
FIG. 2 is a plan view of the assembly comprising the inductor-carrier, the carriage, and the two half-inductors of said device in the open or "retracted" position.
Figure 3:
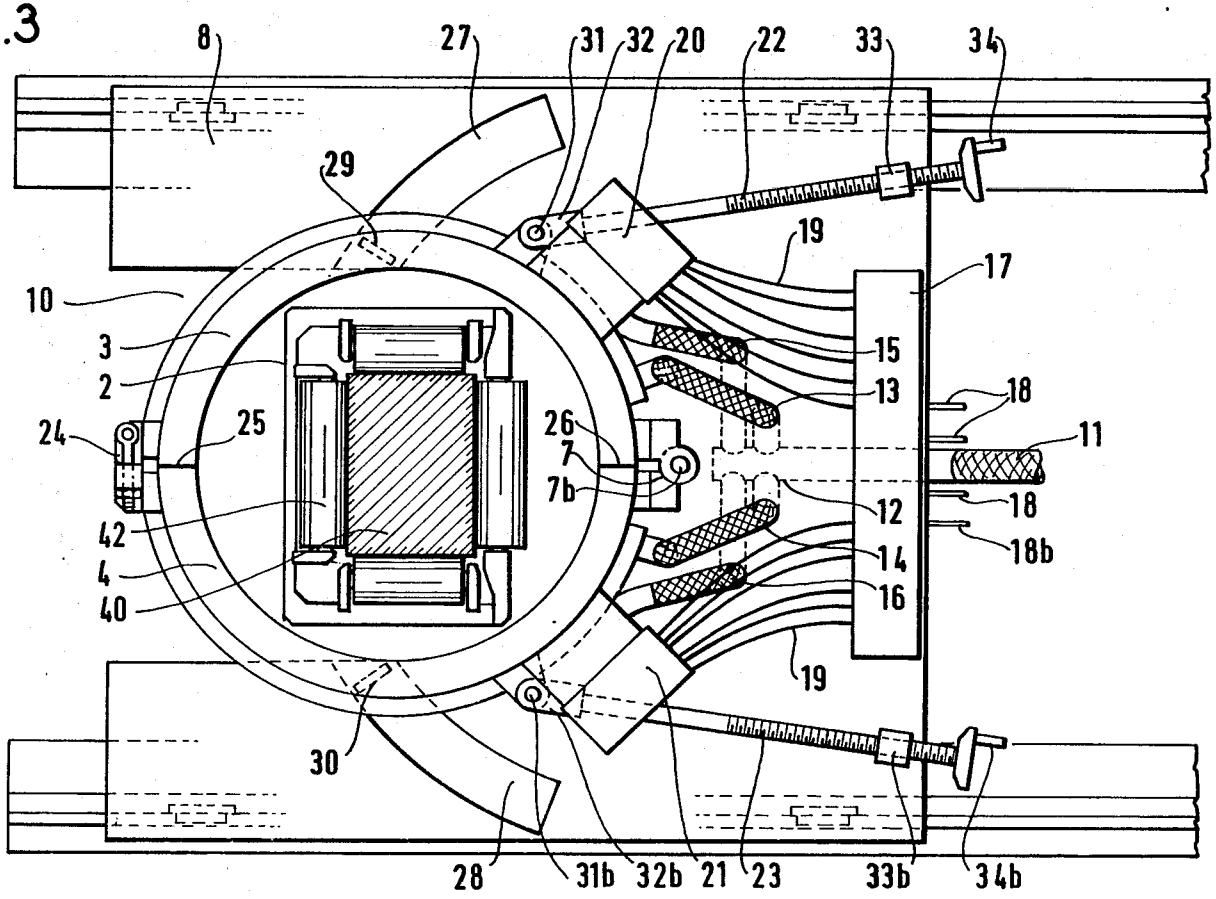
FIG. 3 is a plan view of the same assembly in the closed or "operating" position.

Various details of the inductor-carrier appear in FIGS. 2 and 3.

The rectangular carriage 8 has a large U-shaped notch 10 and two guide tracks 27 and 28. It supports the following:

The two casings 3 and 4 of the two half-inductors, which are supported by their respective supports 5 and 6 which are hinged about the pin 7b of the hinge 7. This pin is fixed to the carriage. The two casings are supported by means of two wheels 29 and 30 which run along the tracks 27 and 28 and each of which receives a fork (not shown) fixed to the base of each of the two casings.

A hydraulic control box for feeding cooling water to the half-inductors: a flexible hose 11 has its upstream end connected to a general water supply network and feeds the hydraulic box 12 with cooling water. Said box then distributes the cooling water to the two half-inductors via ducts 13 and 14. The water returns via two ducts 15 and 16 which meet in a second compartment of the hydraulic box 12, and the water is removed via a hose (not shown) similar to hose 11. A water admission valve (not shown) is controlled from a control desk situated close to the carriage.

An electrical control box 17 fed from equipment of suitable power with three-phase electricity via four flexible cables comprising one cable 18 for each phase and a neutral cable such as 18b. In the present example, each half-inductor comprises three windings, one per phase, requiring six electrical connection wires such as 19, giving a total of 12 wires in all leaving the control box 17.

Two terminal boxes 20 and 21 respectively feeding the half-inductors contained in the casings 3 and 4. The complete circuit diagram of the electrical control box and the two terminal boxes is given in FIG. 4.

Mechanical means 22 and 23 for opening and closing the two moving portions about the hinge 7. Each casing has a gusset plate welded thereto fitted with a rod 31 or 31*b* engaging a fork 32 or 32*b* and providing the required flexibility in use when operated via a screw and nut system 33 or 33*b* by means of a handle 34 or 34*b*. The above description concerns opening and closing under manual control. It is also possible to perform these functions either hydraulically or electrically, with the control being provided either on the carriage or at a control desk.

In FIG. 3 which shows the closed position, i.e. the stirring position, a locking system 24 ensures that the two moving parts are held together sufficiently rigidly for operation and ensures that magnetic flux is closed in spite of the very narrow gaps 25 and 26 (visible in FIG. 5) which remain between the two half-inductors.

In this position, the half-inductors completely surround the continuous casting line, i.e. the cast product 27 and the rolls such as 28 which occupy the segment 2, with the rolls and their bearings being made of non-magnetic austenitic stainless steel.

Each half-inductor comprises, in this case, three windings which are regularly spaced apart. Each of them is fed in phase with the diametrically opposite winding of the other half-inductor. The windings on phase 1 are referenced B1 and B1*b* , on phase 2 they are referenced B2 and B2*b*, and on phase 3 they are referenced B3 and B3*b* (see FIG. 5).

Figure 4:
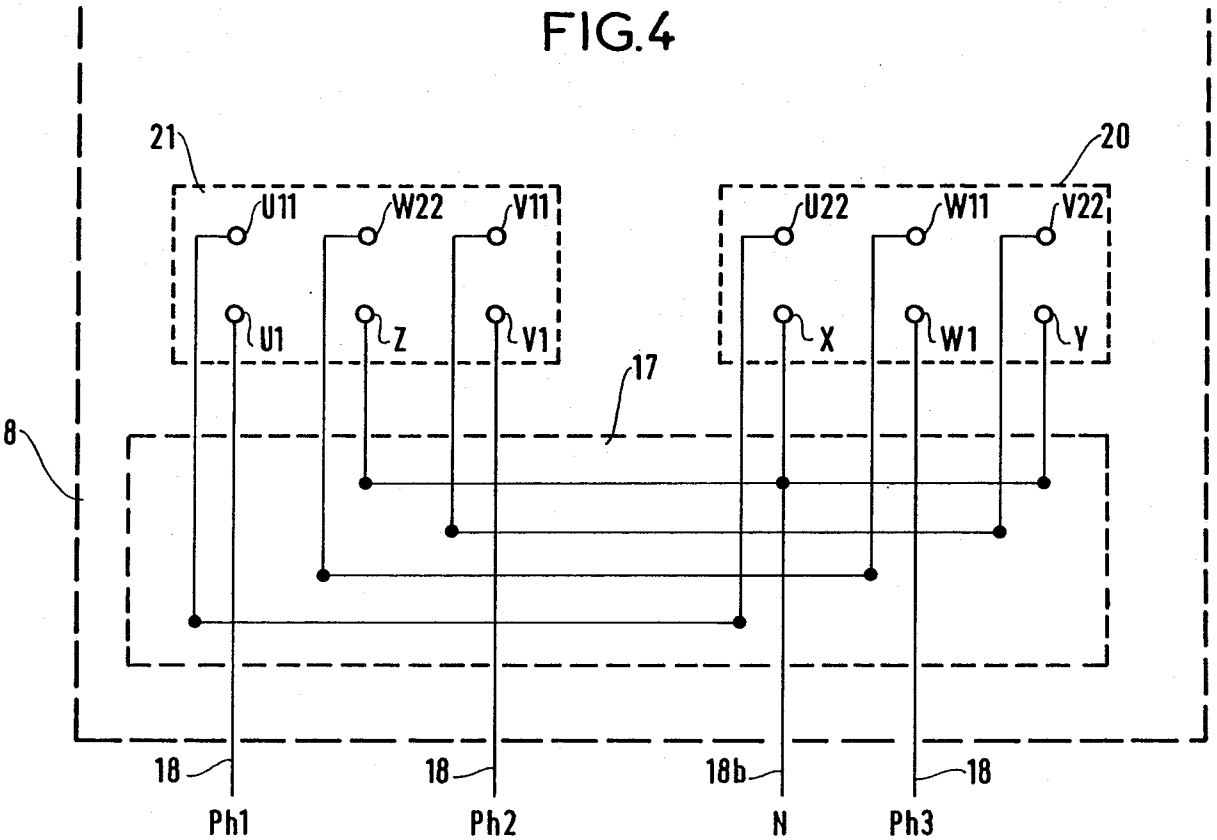
FIG. 4 is an electrical circuit diagram of the control box and two terminal boxes supported by the carriage.

FIG. 4 is the electrical circuit diagram applicable to control block 17 and to the two terminal boxes 20 and 21.

The flexible cables are referenced Ph1, Ph2, Ph3, and N, relating respectively to phases 1, 2, and 3 and to neutral, and they are connected to terminals 18 and 18*b* of the carriage 8.

Terminal U1 of terminal box 21 is fed from phase 1 and it is connected to winding B1 whose other end is connected to terminal U11 in terminal box 21.

Via the control box 17, terminal U1 is connected to terminal U22 of the other terminal box 20. Terminal U22 is connected to winding B1b of the other half-inductor which is located diametrically opposite to winding B1. The other end of winding B1b is connected to terminal X in terminal box 20. In this way, the two windings B1 and B1*b* are in phase and in series.

Similarly, phase 2 runs successively via terminal V1 in terminal box 21, winding B2 in half-inductor 4, terminal V11 in terminal box 21, the control box 17, terminal V22 of terminal box 20, winding B2*b* of the other half-inductor 3, and terminal Y of terminal box 20. Windings B2 and B2*b* are thus in phase and in series.

Finally, phase 3 runs successively from terminal W1 of terminal box 20, via winding B3*b* of the half-inductor 3, terminal W11 of terminal box 20, control box 17, terminal W22 of terminal box 21, winding B3 of the half-inductor 4, to terminal Z of terminal box 21. The two windings B3 and B3*b* are thus in phase and in series.

In the control box 17, the three terminals X, Y, and Z are connected to one another and to terminal 18*b* of the carriage 8, which is in turn connected to the neutral cable N.

Thus, the mechanical device in accordance with the invention together with its electrical control box and its two terminal boxes supported by the carriage is such that the separation of the two half-inductors has no ill effect, in practice, on the electromagnetic efficiency of the assembly formed in this way.

Figure 5:
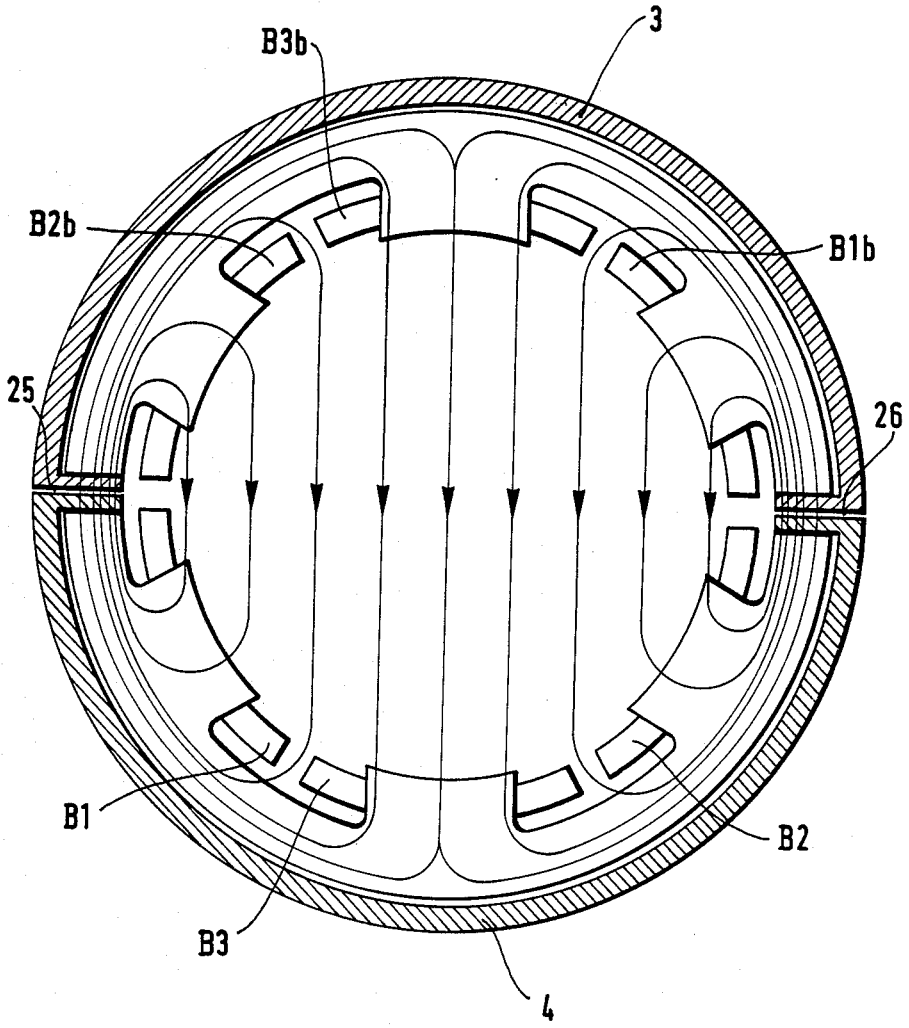
FIG. 5 is a section view through two in-service half-inductors showing the configuration of the magnetic flux lines at a given instant in the electromagnetic cycle.

FIG. 5 is a diagram of the configuration of the magnetic flux at a given instant in the electromagnetic cycle. The flux lines are represented by fine lines. They rotate as the electricity power cycle continues. The gaps 25 and 26 existing between the two magnetic cores are very narrow and reduce the effectiveness of the magnetic flux by very little.

The mechanical device of the present invention applies to any case where a one-piece rotary inductor cannot be positioned at the desired level around a continuous casting line. It is also applicable to a pair of linear inductors which may be difficult to install for special reasons.

Case 1

A continuous casting machine such that installing and maintaining a stirrer at the desired location requires a considerable portion of the machine to be disassembled.

Case 2

A continuous casting machine in which the dummy used to start the line of cast metal is threaded between the rolls and is inserted into the base of the mold by means of a mechanical arm moving in a vertical plane.

At level S and at level F, displacement of the arm makes it impossible to place a conventional type of inductor around the cast product. The device of the invention makes it possible to retract the inductor while this operation is taking place and therefore provides a good solution thereto.

Case 3

A continuous casting machine capable of casting a very wide range of formats and sizes which, for metallurgical and technological reasons require two types of S and F stirrers to be used, for example: one type suitable for stirring large formats and the other type (of smaller inside diameter) being suitable for stirring smaller formats. Successive casting operations including stirring of small formats and then of large formats may be performed without intervention on the machine (without disassembling the inductor suitable for small formats when casting large formats) providing the device of the invention is used for the small format inductor (which can therefore easily be retracted from the line).

Case 4

A continuous casting machine in which the size of the dummy is greater than the largest format cast. With a conventional solution, this case gives rise to the inside diameter of the inductor being designed as a function of the size of the dummy. The device of the invention makes it possible to design the inside diameter solely as a function of the size of the cast product, thereby making it smaller in size and thus requiring lower installed power for given stirring performance.

Naturally, it is possible to design detailed improvements and variants including the use of equivalent means, without going beyond the scope of the invention.

We claim:

1. A device for electromagnetically stirring a liquid metal mass inside a cast product which leaves a mold along a casting axis in a continuous metal casting line, said device including an inductive assembly for placement in an in-service position around said cast product for causing moving magnetic fluxes to penetrate therein so as to perform said stirring, said inductive assembly comprising two separable inductive portions disposed substantially on either side of a plane of separation, passing through said casting axis, each said inductive portion including windings for creating a magnetic flux, a magnetic core for guiding said flux, a cooling circuit, and a rigid casing for holding said winding, said core, and said cooling circuit, said device further including means forming a carriage path having a front end and a rear end, a carriage for carrying said inductive assembly between said front end and said rear end of said carriage path, said inductive assembly being in an in-service position at said front end, and said rear end being at a distance from said cast product, rotation means for rotating each said casing about an axis of rotation which extends substantially parallel to said casting axis in order to separate said inductive portions to open said inductive assembly in order to allow it to be carried on said carriage toward said rear end of said carriage path, an electricity control box for feeding said windings from an external source, and a water control box for feeding said cooling circuits, the improvement wherein:

said two magnetic cores form a substantially closed magnetic circuit around said cast product when said inductive assembly is in its said in-service position, said windings being electrically coupled and cooperating with said magnetic cores for said inductive assembly and forming one inductor which closes around said cast product and which causes said magnetic flux to cross through said cast product and to rotate about said casting axis, said inductive portions being inductor portions, said rotation means comprising a common hinge fixed to both said casing on rear walls thereof for guiding rotation of both said inductor portions about a substantially common axis of rotation close to said rear walls, and support means carried by said carriage for supporting each said casing, holding said magnetic core during said rotation.

2. A device according to claim 1 wherein said carriage is of U-shaped planar form open at a front end with two branches passing on respective sides of said cast product, each of said two branches having a top face including a guide track defining a rotation path on said top face thereof, each of said casings being provided at the bottom thereof with running means which, during rotation, run along a respective guide track, thereby constituting said support means.

3. A device according to claim 1 wherein said continuous casting line has an axis which begins by being substantially vertical and then curves progressively towards a horizontal casting direction by passing through intermediate directions, thereby defining a concave side facing said horizontal casting direction and an opposite, convex side, for permitting a line-supporting structure to be disposed on said convex side and thereby hindering access to the casting line from said convex side;

wherein said axis of rotation extends along one of said intermediate directions close to the vertical with the direction of said carriage path being horizontal in order to facilitate displacement of said carriage, and said rear end of said carriage path being at said concave side of said continuous casting line.

4. A device according to claim 1 wherein said electricity and water control boxes are disposed on said carriage at a rear side of said inductor facing said rear end of said carriage.

5. A device according to claim 4 wherein said water control box is carried by said carriage and is connected to said cooling circuits via flexible ducts and to an external supply via a flexible inlet duct and a flexible outlet duct.

6. A device according to claim 4 wherein said electricity control box is carried by said carriage and feeds said windings by means of flexible wires and via two terminal boxes fixed respectively to said inductor portions.

* * * * *